United States Patent [19]

Jamison

[11] 3,964,265

[45] June 22, 1976

[54] METHOD AND APPARATUS FOR MINING AND SUPPORTING THE MINE ROOF

[75] Inventor: Will B. Jamison, Bethel Park, Pa.

[73] Assignee: Consolidation Coal Company, Pittsburgh, Pa.

[22] Filed: Oct. 7, 1974

[21] Appl. No.: 512,673

Related U.S. Application Data

[60] Division of Ser. No. 391,032, Aug. 23, 1973, Pat. No. 3,871,707, which is a continuation-in-part of Ser. No. 286,744, Sept. 6, 1972, abandoned.

[52] U.S. Cl. ..... 61/45 C; 61/45 D

[51] Int. Cl.[2] ..... E21D 15/44

[58] Field of Search ..... 61/45 D, 45 R, 45 C, 61/63, 84, 85; 299/31, 33; 248/357; 91/170 MP

[56] References Cited

UNITED STATES PATENTS

| | | | |
|---|---|---|---|
| 3,115,754 | 12/1963 | Joseph | 61/45 D |
| 3,482,407 | 12/1969 | Rieschel | 61/45 D |
| 3,541,926 | 11/1970 | Grebe | 61/45 D X |
| 3,621,661 | 11/1971 | Allen | 61/45 D |
| 3,678,693 | 7/1972 | Markewitz et al. | 61/45 C |
| 3,812,680 | 5/1974 | Walbrohl | 61/45 C |

*Primary Examiner*—Dennis L. Taylor

[57] ABSTRACT

A portable temporary roof support is arranged to be on a mining machine to a location beneath an unsupported portion of a mine roof. The portable temporary roof support has a plurality of piston cylinder devices that are connected by conduits to a source of fluid under pressure on the continuous mining machine. Fluid under pressure from the mining machine first extends the temporary roof support laterally to a location adjacent the entry ribs and thereafter extends the vertical portions of the temporary roof support into abutting relation with the mine roof and the mine floor to support the unsupported portion of the mine roof.

3 Claims, 12 Drawing Figures

A
B
C
D
E
F
G
H
I
100
144
146
200
202
204
204A
204B
206
208

METHOD AND APPARATUS FOR MINING AND SUPPORTING THE MINE ROOF

CROSS-REFERENCE TO RELATED APPLICATION

This is a division of application Ser. No. 391,032, filed Aug. 23, 1973 entitled "Method And Apparatus For Mining And Supporting The Mine Roof", now U.S. Pat. No. 3,871,707 which in turn is a continuation-in-part of U.S. Pat. application, Ser. No. 286,744 filed on Sept. 6, 1972, now abandoned.

BACKGROUND OF THE INVENTION

1. Field of the Invention

This invention relates to a method and apparatus for mining and supporting the mine roof and more particularly to a method and apparatus for providing temporary roof support while the mining machine advances to form a second unsupported portion of the mine roof and for providing temporary roof support adjacent the location where permanent roof supports are to be installed in the second unsupported portion of the mine roof.

2. Description of the Prior Art

In underground mining especially the mining of coal the length of unsupported roof formed during the mining operation is limited to a preselected length as for example twenty feet. It is necessary after twenty foot of unsupported roof is formed to withdraw the mining machine from the entry to a cross-heading and thereafter move a bolting machine beneath the unsupported portion of the roof and provide permanent support by first drilling vertical holes in the roof and anchoring roof supports in the predrilled holes. Thus with the present practice the continuous penetration of the mining machine is limited to the preselected length of unsupported roof.

Further, in conventional mining the self-propelled roof drill and bolter sets rows of bolts inby of the last row of bolts. The setting of the row of bolts requires the self-propelled drill and bolter to first drill vertical holes in the rows and thereafter to anchor roof bolts therein. The personnel operating the roof drill and bolter are frequently working beneath a portion of the unsupported roof. There is a need for a method of temporarily supporting unsupported portions of the roof so that the continuous miner can advance a distance greater than the predetermined distance now limited by the unsupported roof and further a method of temporarily supporting the roof where the roof drill and bolter personnel are working without exposing the personnel to the hazards of unsupported roof and thus provide a roof section that is supported in substantially the same manner as by the permanent roof bolts while the roof bolts are being installed.

In order to provide some protection for the personnel operating the roof drill and bolter it has been the practice in the past to manually set several temporary jacks or posts inby of the location where the rows of bolts are to be set to thus reduce the danger of roof fall for the personnel setting the line of roof bolts. The manual placement of the temporary jacks is not satisfactory because it exposes the personnel setting the jacks to the same hazards as the personnal operating the roof drill and bolter under unsupported roof.

SUMMARY OF THE INVENTION

This invention is directed to a method and apparatus for mining and supporting the mine roof which includes advancing the mining machine in the entry of an underground mine and dislodging material from the face to form a first unsupported portion of the mine roof having a preselected length. Thereafter the first unsupported portion of the mine roof is supported by a first portable temporary roof support that is preferably carried by the mining machine. After the first unsupported portion of the mine roof is supported by the first portable roof support the mining machine continues to advance and dislodges additional material from the face to form a second unsupported portion of the mine roof. The mining machine is thereafter withdrawn from the entry and a roof drill and bolter is trammed into the entry beneath the first unsupported portion of the mine roof. Permanent roof supports, such as roof bolts, are inserted in the first unsupported portion of the mine roof while the first unsupported portion remains supported by the portable temporary roof support. Thereafter permanent roof supports are inserted in the second unsupported portion of the mine roof.

While inserting permanent roof supports in the second unsupported portion of the mine roof a second temporary roof support is provided beneath a portion of the second unsupported portion of the roof by a temporary roof support device carried by the self-propelled roof drill and bolter. Fluid under pressure from the self-propelled roof drill and bolter is supplied to the second temporary roof support into a roof supporting position. The self-propelled roof drill is thereafter maneuvered adjacent to the second temporary roof support to drill a row of bolt holes and set a row of bolts therein. Thereafter the roof drill and bolter engages the temporary roof support and retracts the telescopic jacks and again repositions the secondary temporary roof support to provide roof support at another location beneath the second unsupported portion of the mine roof.

The first temporary roof support carried by the mining machine includes a frame member having a pair of spaced parallel side beams connected by a plurality of spaced parallel telescopic transverse connecting members. Depending telescopic leg members are hingedly connected to the side beams and have elongated base portions. A mesh type canopy is secured to portions of the transverse connecting members. A hydraulic circuit for the fluid actuated telescopic leg members and transverse members includes an accumulator to maintain pressure and roof support even if slight hydraulic leakage occurs in the hydraulic circuit and a pressure relief valve to permit limited deflection of the support under certain roof conditions.

Accordingly, the principal object of this invention is to provide a method and apparatus for increasing the distance a continuous mining machine can penetrate in an entry without interruption of the mining operation to install permanent roof supports.

Another object of this invention is to provide a temporary roof support under one section of unsupported mine roof while the continuous mining machine advances to form another section of unsupported roof.

Another object of this invention is to provide a method and apparatus for positioning a portable temporary roof support inby of a location where a row of bolts is to be set without requiring the operating personnel to work under unsupported roof.

These and other objects of this invention will be more completely disclosed and described in the following specification, the accompanying drawings and the appended claims.

DESCRIPTION OF THE DRAWINGS

FIG. 6 further illustrates in phantom the temporary portable roof support in a retracted position carried by the mining machine.

DESCRIPTION OF THE PREFERRED EMBODIMENTS

The apparatus for installing the permanent roof supports in the mine roof, the portable roof support apparatus associated therewith and the method for supporting portions of the unsupported roof while installing permanent roof supports, as illustrated in FIGS. 1–4, will first be described. Thereafter the temporary portable roof support apparatus transported by the mining machine and illustrated in FIGS. 5–8 for providing temporary roof support under an unsupported section of the mine roof will be described and the method of mining and supporting the roof, as illustrated in FIGS. 9–12, utilizing the apparatus illustrated in FIGS. 5–8 will be described.

Throughout the specification reference will be made to the dislodging of coal from a mine face in an underground coal mine. It should be understood, however, that the hereinafter described method and apparatus may be employed in the underground mining of other materials where roof support, both temporary and permanent, is required. Further, the apparatus for installing permanent roof supports will be referred to as a roof drill and bolter where conventional expandable roof bolts are employed as the permanent roof support.

The same apparatus could be employed with other types of permanent roof support, such as resin secured bolts and the like.

Figure 1:
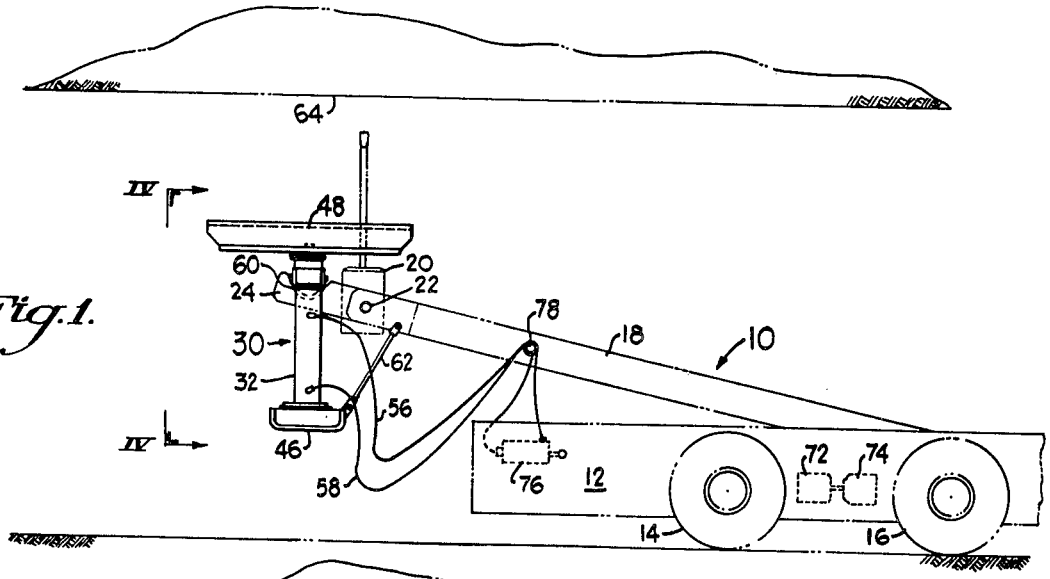
FIG. 1 is a view in side elevation of the roof drill having a temporary portable roof support carried by the boom of the roof drill in a retracted position.
Figure 2:
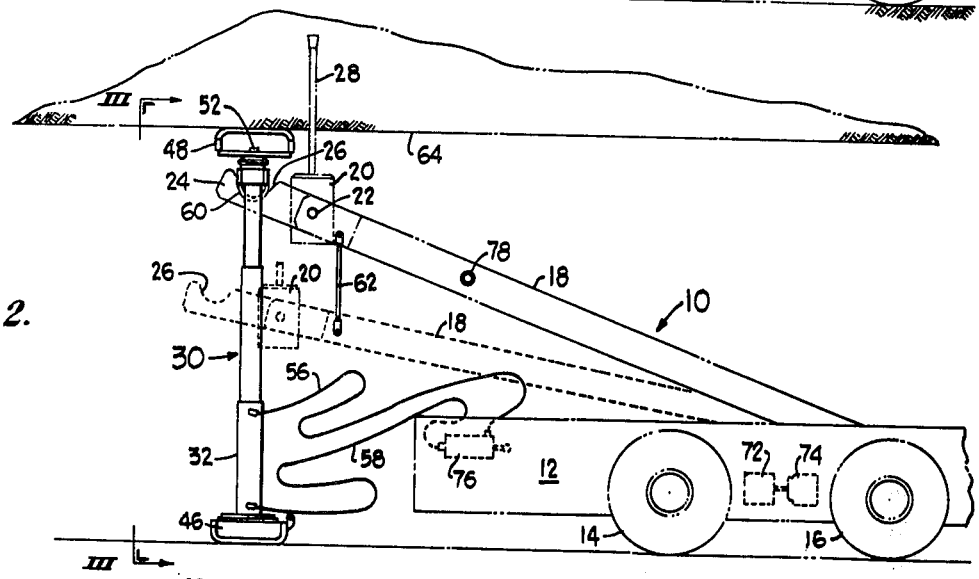
FIG. 2 is a view in side elevation, illustrating the roof support in an extended roof supporting position with the roof drill boom detached from the temporary portable roof support.
Figure 3:
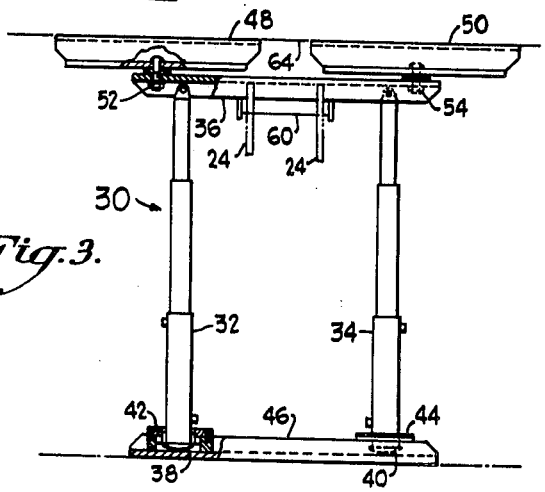
FIG. 3 is a view in front elevation taken along the line III—III of FIG. 2, illustrating the roof support in an extended position.
Figure 4:
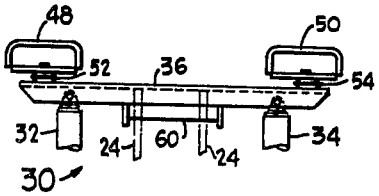
FIG. 4 is a fragmentary view in front elevation, illustrating the pads on the roof support rotated to a position parallel to the roof drill boom member for transportation through the mine.

Referring to the drawings and particularly FIGS. 1 and 2 there is illustrated diagrammatically a roof drill and bolter generally designated by the numeral 10 that has a body portion 12 supported on pairs of propelling wheels 14 and 16 and a longitudinally extending boom 18. The boom 18 is pivotally secured to the body 12 and has a drill pot or drill unit 20 pivotally secured by means of pins 22. The drill 10 may be any conventional roof drill as, for example, the roof drills manufactured and sold by Galis Manufacturing Division - Fairmont, W. Va. as Models 300, 310 and 320.

The boom 18 has a pair of forwardly extending saddle plates 24 with an arcuate recessed portion 26 therein. The saddle plates 24 preferably terminate closely adjacent the end of boom 18 so that the saddle plates 24 do not interfere with the drilling and bolting operation as the drill pot 20 moves upwardly against the mine roof. Also, the saddle plates 24 can be rigidly secured to the boom in angular relation and extend forwardly from the boom a greater distance and not interfere with the drilling and bolting operation and provide adequate clearance for the upward movement of the roof drill into the mine roof.

The drill unit 20 is arranged to receive a drill stem 28 in a chuck and rotation is provided for the drill by suitable hydraulic or pneumatic means. The roof drill 10 has a hydraulic pump 72 mounted thereon and suitably driven by an electric motor 74. The pump 72 and motor 74 are schematically illustrated in FIGS. 1 and 2 and are conventional to provide fluid under pressure for the hydraulic system of the roof drill 10. The hydraulic system for the roof drill 10 is also conventional and is not illustrated with the exception of a value 76 for controlling the flow of fluid under pressure to the portable roof support 30. The boom member 18 has a laterally extending hanger 78 for supporting hydraulic hoses as later explained.

The portable roof support 30 has a pair of telescopic jacks 32 and 34 that are arranged to be extended and retracted by fluid under pressure and, where desired, may also be maintained in an extended position by fluid under pressure. The jacks 32 and 34 may include suitable check valves so that they remain in an extended position in the absence of fluid under pressure being supplied thereto. The jacks 32 and 34 are connected at one end to an upper cross member 36 and have semispherical base portions 38 and 40. The base portions 38 and 40 are secured in sockets 42 and 44 of a bottom cross member 46.

A pair of pads 48 and 50 are connected to the upper cross member 36 by pins 52 and 54 in a manner that the pads 48 and 50 are rotatable relative to the cross member 36 so that they may be aligned with the longitudinally extending boom 18, as illustrated in FIG. 1, while the drilling machine 10 is trammed through confined haulageways. The rotation of the pads 48 and 50 to the position illustrated in FIGS. 1 and 4 reduces substantially the width of the portable roof support 30. The pads 48 and 50 are rotatable to the position illustrated in FIGS. 2 and 3 to provide an elongated load bearing surface transversely across the haulageway.

A pair of elongated flexible hydraulic hoses 56 and 58 are connected at one end through valve 76 to the hydraulic system of the roof drill 10 and at the other end to inlet openings in each of the jacks 32 and 34.

The valve 76 located preferably at the operator's compartment of the roof drill is arranged to selectively provide fluid under pressure from the roof drill hydraulic system to the double acting jacks to either extend or retract the telescopic jacks 32 and 34 to the positions illustrated in FIGS. 1 and 2. Suitable valving within the jacks 32 and 34 may be provided to permit setting the jacks with a controlled pressure and the yielding of the jacks at a controlled pressure, which is usually twice the setting pressure. The valving within the jacks preferably provides holding support should the hydraulic hoses 56 and 58 be damaged or a loss of hydraulic pressure be experienced in the hydraulic system of the roof drill. In the drawings telescopic, double acting jacks are illustrated to provide the range of heights shown. It should be understood, however, that single acting jacks and non-telescopic jacks may also be employed without departing from the scope of the invention.

The transverse upper cross member 36 of the portable temporary roof support 30 has a semi-circular depending bearing plate 60 secured thereto that has substantially the same configuration as the arcuate recess 26 in saddle plates 24. A connecting rod 62 is pivotally secured at one end to the saddle plates 24 and detachably secured at the other end to the bottom transverse member 46. With this arrangement, the rod 62 is arranged to secure the portable roof support 30 to the saddle 24 and prevent the roof support 30 from swinging while the drill 10 is tramming in the mine. It should be understood, however, that the connecting rod 62 is not essential to practice the herein described invention.

Where desired an accumulator may be provided on the roof support 30 and the hydraulic conduits 56 and 58 connected through suitable valving to the accumulator and separate conduits similar to conduits 56 and 58 connected in the hydraulic circuit to the hydraulic system of the roof drill 10. Also, quick disconnect couplings could be provided in the hydraulic circuit to disconnect the roof support 30 from the roof drill 10 while the roof support 30 is in an extended roof supporting position.

The apparatus above described operates in the following manner. The portable roof support 30 is retracted by fluid under pressure from the hydraulic system of the roof drill 10 to the position illustrated in FIG. 1 and the saddle plates 24 extend between the jacks 32 and 34 within the arcuate bearing plate 60 on the support cross member 36 positioned in the arcuate recess 26 of saddle plates 24. The drill boom 18 is elevated to the position illustrated in FIG. 1 and the bearing pads 48 and 50 are pivoted about pins 52 and 54 to be substantially aligned with the drill boom 18 and thus reduce the width of the support 30. If desired, a rod 62 can be connected to the support base member 46 and the saddle plates 24. In the position illustrated in FIG. 1 the roof drill 10 with the portable roof support 30 carried by the boom member 18 trams along the haulageway to the working section of the mine where the roof is to be bolted for roof support. As is illustrated in FIG. 1, there is substantial vertical clearance between the mine roof 64 and floor 66 so that the portable roof support 30 does not interfere with the tramming of the roof drill 10.

When the roof drill 10 is trammed to a location adjacent the location where the rows of bolts are to be set and preferably while the portable roof support 30 carried by the drill boom 18 is beneath a bolted section of the roof, the pads 48 and 50 are rotated to a position substantially transverse to the longitudinal axis of the boom 18. Thereafter, the drilling machine 10 is further advanced to a location where it is inby of the line where the bolts are to be set. Thus, the portable roof support 30 is between the working face and the line where the bolts are to be set as is illustrated in FIG. 2. At this location hydraulic fluid under pressure is provided through the hydraulic hoses 56 and 58 to the telescopic jacks 32 and 34 to expand the jacks 32 and 34 so that the upper pads 48 and 50 contact the roof 64 and the transverse base member 46 contacts the mine floor 66 to thus provide support for the mine roof 64 at that location.

Suitable hydraulic pressure is maintained by the hydraulic system of the roof drill 10 on the jacks through the hoses 56 and 58 to support the roof at the location of the portable support 30. The drilling machine boom 18 is then moved downwardly to free the saddle members 24 from the support cross member 36. The hydraulic hoses 56 and 58 are disengaged from the hanger on the boom 18 of the drilling machine 10 and have sufficient length to permit the drilling machine 10 to maneuver behind the portable roof support 30 and drill a series of holes transversely in the roof 64 and insert bolts therein. It should be understood, where desired, that suitable hose reels or the like may be provided for the hoses 56 and 58 to prevent the hoses from being damaged by the drilling machine 10 and accumulators may also be provided on the jacks to provide a reservoir of fluid under pressure.

With the above described arrangement, the unbolted portion of the roof adjacent the location where the rows of bolts are being set is supported by the portable roof support 30. After the row of bolts has been set, the boom 18 is elevated and positioned with the recessed portion 26 of the saddle plates 24 abutting the arcuate bearing plate 60 and hydraulic valving within the roof drill 10 is actuated to provide fluid under pressure to retract the telescopic jacks 32 and 34 and the portable roof support can then be advanced while suspended from the drill boom 18 to a location inby of the location where the next row of bolts are to be set. The jacks 32 and 34 can again be expanded to provide support for the roof at this new location. The boom 18 is then again lowered and the drilling machine 10 maneuvered to drill the next holes in the roof and position the next transverse row of bolts therein. After the section of the roof adjacent the working face is properly bolted the portable roof support 30 is again engaged by the saddle members 24 and the telescopic jacks 32 and 34 are retracted and the pads 48 and 50 rotated to the position illustrated in FIG. 1. Thereafter, the drilling machine 10 is trammed to a new location where the above bolting operation is repeated. With this arrangement, the portable roof support 30 is transported with the roof drill 10 to the bolt locations and is detached from the roof drill after it is in an extended supporting position with the exception of the hydraulic hoses 56 and 58. The hoses 56 and 58, however, have sufficient length to permit the drilling machine 10 to maneuver relative to the portable roof support 30 and drill suitable bolt holes and set the roof bolts therein. As previously discussed, the hoses 56 and 58 may include disconnect couplings to permit the roof support to be extended into a roof supporting position and drilling machine 10 disconnected therefrom to permit greater freedom in the maneuverability of the drilling machine 10.

Temporary Portable Roof Support Apparatus Illustrated In FIGS. 5–8

Figure 5:
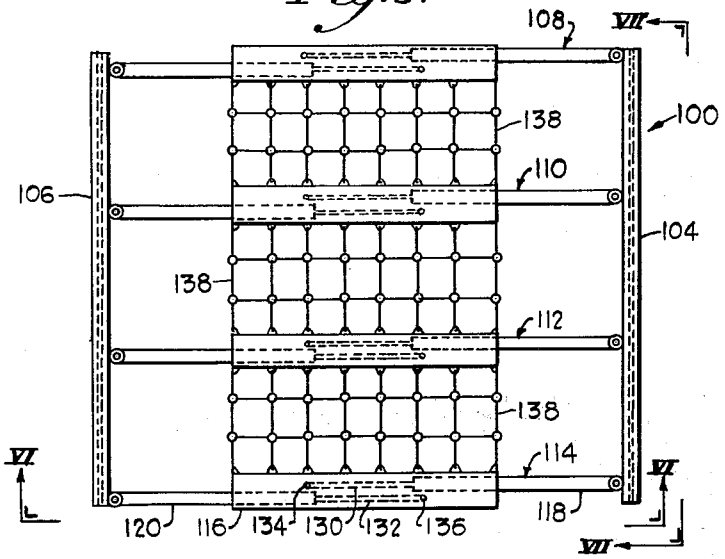
FIG. 5 is a top plan view of the temporary portable roof support carried by the mining machine.
Figure 6:
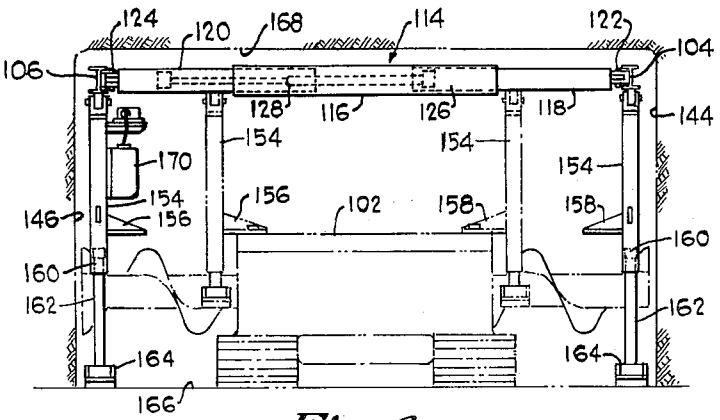
FIG. 6 is a view in side elevation of the temporary portable roof support illustrated in FIG. 5 taken along the line VI—VI of FIG. 5.

Referring to FIGS. 5–8 there is illustrated temporary portable roof support apparatus generally designated by the numeral 100 which is arranged to be transported by a mining machine partially illustrated in FIG. 6 and designated by the numeral 102. It should be understood that the temporary portable roof support 100 may be employed with any type of continuous mining machine, such as a borer type mining machine or the drum type mining machine illustrated in the drawings.

Figure 8:
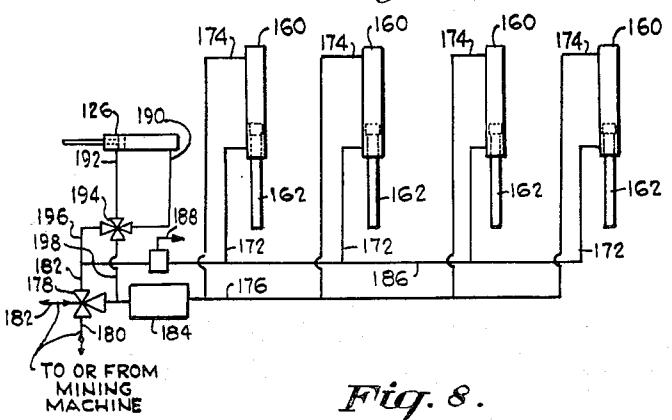
FIG. 8 is a schematic hydraulic diagram for extending and retracting the telescopic portions of the temporary portable roof support illustrated in FIG. 5.

The temporary portable roof support 100 is designed to utilize hydraulic fluid under pressure generated by the hydraulic pumps on the mining machine 102 as the power operated means to expand and retract the telescopic components of the temporary portable roof support 100. The source of hydraulic fluid under pressure on the mining machine 102 is suitably connected into the circuit for the telescopic members of the temporary portable roof support 100 by quick disconnect couplings or the like. With this arrangement the continuous mining machine 102 may transport the temporary portable roof support to a desired location and with hydraulic pressure supplied by the mining machine and connected to the hydraulic circuit of the temporary portable roof support 100 by flexible hoses expand the telescopic components of the temporary portable roof support to position the temporary roof support adjacent the ribs or side walls of the mine entry and also in abutting relation with the mine roof and mine floor to provide support for the unsupported roof thereabove. The hydraulic connections between the mining machine 102 and temporary portable roof support 100 may thereafter be disconnected to permit the mining machine 102 to further advance in the entry as will be later described. To simplify the illustration the flexible hose connections between the mining machine 102 and the portable roof support 100 have been omitted and a hydraulic diagram of the system is illustrated in FIG. 8.

The temporary portable roof support 100 has a pair of side beams 104 and 106 that have a fixed length. The length of the side beams 104 and 106 determine the length of the unsupported roof that will supported by the temporary roof support 100. It is, therefore, desirable that the temporary portable roof support 100 have a length substantially equal to the longest length of the unsupported roof permitted before the mining machine must withdraw for the installation of permanent roof supports in the unsupported portion of the mine roof.

The temporary portable roof side beam members 104 and 106 are hingedly connected to each other by a plurality of transverse telescopic connecting members generally designated by the numerals 108, 110, 112 and 114. The transverse connecting members are of similar construction and are employed to extend the side beam members to a location adjacent the entry ribs and to retract the side beam members to permit the portable roof support to be transported in the narrow mine entry by the mining machine.

The transverse members each include a box like cylinder section and a pair of telescopic arms 118 and 120 slidably positioned therein and extending outwardly therefrom. The arms 118 and 120 are hingedly connected at their ends to the side beams 104 and 106 by pin like connections 122 and 124. The arms each have a fluid actuated piston cylinder assembly 126 and 128 with piston rods 130 and 132 extending therefrom. The piston rods 130 and 132 have their end portions connected at 134 and 136 to the box like cylinder section 116. Suitable wire mesh or wire rope netting 138 connected between the box like members 116 to support small fragments of the roof that may be dislodged during the mining operation.

With this arrangement the side beam members 104 and 106 are movable toward and away from each other to retract the side beam members 104 and 106, as illustrated in FIG. 6, while the temporary portable roof support 100 is being transported by the mining machine 102 and extend the side beam members 104 and 106 to the position illustrated in FIGS. 5 and 6 adjacent to the ribs or side walls 144 and 146 of the mine entry.

Figure 7:
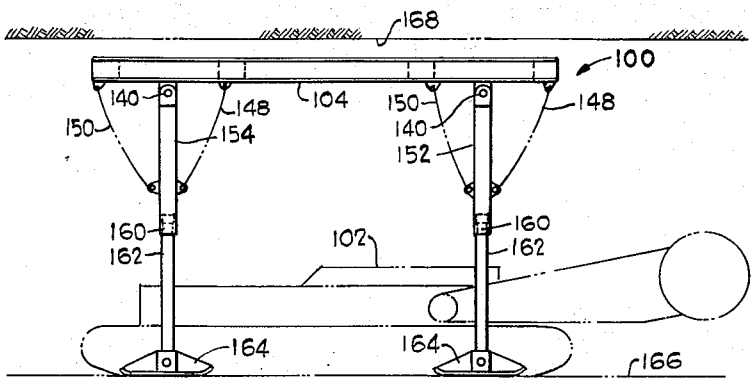
FIG. 7 is a view in side elevation of the temporary portable roof support taken along the line VII—VII of FIG. 5.

The temporary portable roof support 100 has a first pair of depending legs 152 and 154 hingedly connected adjacent the upper portions to the side beam 104 as illustrated in FIG. 7. A similar pair of depending legs are connected to the other side beam 106, only one of which is illustrated in FIG. 6. The pairs of legs 152 and 154 are connected to the respective beams 104 and 106 by pin type hinge connections 140. Flexible cables 148 and 150 are connected to the respective legs 152 and 154 and the beam members 104 and 106 to limit the side motion of the legs 152 and 154. The legs 152 and 154 also have inwardly extending pads 156 and 158 which are arranged to abut portions of the mining machine so that the mining machine 102 can support and transport the temporary portable roof support 100 to a desired location within the mine entry, as later discussed.

The legs 152 and 154 are of similar construction and each include a piston cylinder assembly 160 with the piston rod and the piston rod portion 162 forming a portion of the leg 154. An elongated base pad 164 is connected to the end of the rod 162 and is arranged to abut the mine floor 166. With this arrangement the rod portion 162 of all of the legs 152 and 154 may be retracted for transporting the temporary roof support 100 through the mine entry and may be extended by fluid under pressure supplied from the mining machine into a position abutting the mine floor 166 and urging the side beams 104 and 106 against the mine roof 168. An accumulator 170 is mounted on one of the legs 154 and the valves hereinafter discussed may be mounted at any suitable location and as illustrated in FIG. 5 on the other leg 154.

Now referring to the hydraulic diagram illustrated in FIG. 8, the piston cylinder assembly 160 for the four legs is illustrated diagrammatically with fluid inlet and outlet conduits 172 and 174 on opposite sides of the piston within the cylinder of the piston cylinder assembly 160. The conduits 174 are connected to a common conduit 176 which, in turn, is connected through a three-way valve 178 to flexible conduits 180 and 182 which are, in turn, connected to the hydraulic system of the mining machine. An accumulator 184 is positioned in the conduit 176 between the valve 178 and the piston cylinder assemblies 160. A second conduit 186 connects the lower portion of the piston cylinder assemblies to the three-way valve 178 and has a pressure relief valve 188 therein. With this arrangement when fluid under pressure is supplied to the piston cylinder assemblies 160 of the legs 152 and 154 to extend the legs, fluid under pressure flows from the mining machine through flexible hosing 180 to valve 182 and through conduit 176 to move the leg portions 162 downwardly to extend the legs 152 and 154.

The accumulator 184 is provided for a reserve of fluid under pressure so that a preselected hydraulic pressure is maintained on the pistons even if slight leakage occurs in the piston cylinder assemblies or the conduits from the lower portion of the piston cylinder assemblies. The relief valve 188 permits the temporary portable roof support to be deflected by slight movement of the roof strata while supporting the roof strata.

There is also provided conduits 190 connected to the plurality of piston cylinder assemblies 126 and 128 of the transverse members 108–114, only one of which is shown in FIG. 8. Other conduits 192 are connected to the piston cylinder assemblies on the opposite side of the piston. Conduits 190 and 192 are connected to a valve 194 which has ports connected by means of conduits 196 and 198 to the main conduits 176 and 186. With this arrangement fluid under pressure supplied from the mining machine is arranged to extend and retract the piston cylinder assemblies 126 and 128. It should be understood that the hydraulic circuit diagrammatically illustrated in FIG. 8 is for exemplary purposes only and other circuit arrangements could be provided for extending and retracting the various members above described.

Figures 9, 10, 11, 12:
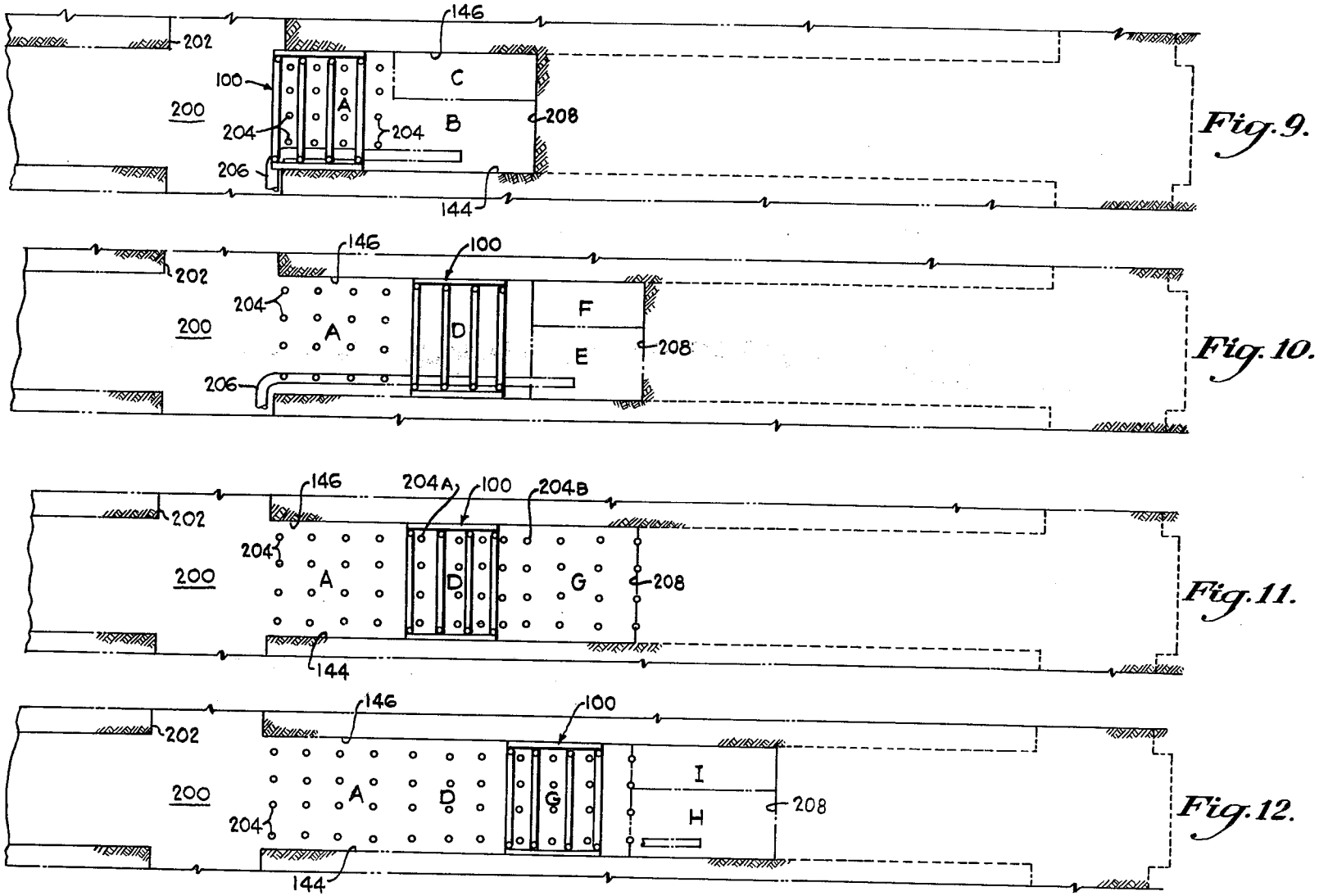
FIGS. 9, 10, 11 and 12 are schematic plan views of a mine entry illustrating the manner in which the temporary portable roof support may be employed to increase the distance which the continuous miner may dislodge material from the face without interrupting the mining operation to install permanent roof supports in unsupported portions of the mine roof.

Referring to FIGS. 9–12, there is illustrated schematically a plan view of an entry 200 in an underground mine which entry is formed by the dislodging of coal or other material by a continuous mining machine similar to the mining machine 102. FIG. 9 illustrates the entry adjacent a cross-heading 202 that has permanent roof supports 204 installed therein so that the area A is a supported portion of the roof. The temporary roof support 10 is moved by the mining machine into position beneath area A of the mine roof. The mining machine releases the temporary roof support and then advances along the rib 144 dislodging coal to make a first cut designated by the letter B. Thereafter a ventilation tube 206 is positioned in area B and the mining machine retracts into area A and again advances along the rib 146 dislodging coal to make a second cut designated by the letter C. After making cuts B and C the distance between the mine face 208 and the last row of permanent roof supports 204 is approximately twenty feet so that there is approximately twenty foot of unsupported roof between the mine face 208 and the last row of permanent roof supports 204.

The mining machine after making cut C retracts beneath the temporary roof support 100 and picks up the temporary roof support 100 and advances into the entry to a location approximately four feet from the mine face 208. The temporary roof support 100 is then expanded to a position adjacent the ribs 144 and 146 and the legs 152 and 154 are expanded so that the temporary roof support supports the portion of the unsupported roof formed by cuts B and C which is designated in FIG. 10 as area D.

The mining machine then advances into the mine face dislodging coal adjacent the rib 144 making cut E. A ventilation tube 206 is then advanced into the area formed by cut E and the mining machine retracts and advances into the face adjacent the rib 146 to make cut F. Cuts E and F have advanced the mine face 208 a distance of approximately fifteen feet so that the distance between the last row of permanent roof supports 204 and the mine face 208 is now approximately 35 feet. This entire area is unsupported roof. The rear portion of the roof adjacent the last row of permanent roof supports 204, however, is supported by the temporary roof support 100.

After cuts E and F have been made the mining machine is withdrawn to the cross entry 202 and, as illustrated in FIG. 11, a drill and bolter similar to the drill and bolter 10 illustrated in FIGS. 1–4 advances in the entry 200 from the cross entry 202 and installs rows of permanent roof supports designated 204A in that portion of the roof supported by the temporary roof support 100. After approximately four rows of permanent roof supports have been positioned in the roof above and adjacent to the temporary roof support 100 the drill and bolter 10 is advanced into the area designated by the letter G in FIG. 11 which was formed by cuts E and F illustrated in FIG. 10.

The drill and bolter 10 advances and positions the second temporary roof support 30 to support a portion of the unsupported roof while four additional rows of permanent roof supports 204B are inserted in the roof in area G. It should be understood, as previously described, the temporary roof support 30 associated with the drill and bolter 10 may be repositioned several times within the area G to provide support for the personnel operating the roof drill and bolter while the four rows of permanent roof supports are being positioned in the roof.

After the permanent roof supports have been installed, the drill and bolter 10 is withdrawn from the entry 200 and the mining machine again advances into the entry 200. When the mining machine arrives at area D the mining machine picks up the temporary roof support 100 and advances the temporary roof support 100 to area G. The mining machine thereafter advances and dislodges coal from the mine face first by making cut H and thereafter again retracts and advances to make cut I. The same procedure is then repeated as illustrated in FIG. 10 in that the mining machine retracts and picks up the temporary roof support 100 in area G and advances the roof support to the area formed by cuts H and I similar to the procedure of advancing the temporary roof support from area A to area D as illustrated in FIG. 10. Thereafter the temporary roof support is expanded to support the unsupported roof in the area formed by cuts H and I and the mining machine again advances to make two cuts similar to cuts E and F as illustrated in FIG. 10. After the second pair of cuts are made the mining machine is again withdrawn and the drill and bolter 10 is moved into position to provide permanent roof supports for the area of the roof supported by the temporary roof support 100 and thereafter the portion of the unsupported roof between the temporary roof support and the mine face 208.

It will be apparent with this method that it is now possible to advance the mining machine approximately twice the distance previously permitted by utilizing the temporary roof support and thus increasing production by eliminating the withdrawal of the mining machine after each area of unsupported roof above discussed is formed. Although various lengths of unsupported roof are described and the forming of the sections by making two separate cuts is described, it should be understood that the dimensions and the manner of dislodging the coal are for exemplary purposes only and the above apparatus may be utilized in other methods where conditions permit greater or smaller lengths of unsupported roof and where the mining machine forms the above discussed areas in the entry by a single or a plurality of cuts.

According to the provisions of the patent statutes, I have explained the principle, preferred construction and mode of operation of my invention and have illustrated and described what I now consider its best embodiments. It should be understood that the invention is not limited to the particular embodiments described herein but may be variously practiced within the scope of the following claims.

I claim:

1. A temporary roof support for use in a mine comprising, a pair of spaced parallel side beams, a plurality of spaced parallel telescopic transverse members connecting said side beams and forming a frame member, a first pair of leg members connected to one of said beam members in spaced relation to each other, a second pair of leg members connected to the other of said beam members in spaced relation to each other, each of said leg members having telescopic means to extend and retract said leg members and move said frame member into abutting relation with a mine roof and said leg members into abutting relation with a mine floor to thereby provide support for said mine roof, support means secured to certain of said leg members and extending outwardly therefrom, said support means arranged to abut portions of a self-propelled mining machine so that said mining machine is operable to support, carry and transport said temporary roof support, fluid pressure operated means associated with said telescopic means to extend and retract said pairs of leg members and urge said frame member into abutting relation with said roof, a circuit for said telescopic means and said fluid pressure operated means, and a pressure accumulator in said circuit to provide a reserve of fluid under pressure for said fluid pressure operated means.

2. A temporary roof support as set forth in claim 1 which includes, other telescopic means associated with said transverse members arranged to move said side beams toward and away from each other to control the lateral dimension of said frame member.

3. A temporary roof support as set forth in claim 1 which includes, a pressure relief valve in said circuit to limit the fluid pressure in said circuit to a preselected fluid pressure.

* * * * *